United States Patent [19]

Weinberg

[11] 4,245,763

[45] Jan. 20, 1981

[54] DEVICE FOR CARRYING GARMENT BAG

[76] Inventor: Judd A. Weinberg, 165 W. Lake St., Northlake, Ill. 60164

[21] Appl. No.: 65,944

[22] Filed: Aug. 13, 1979

[51] Int. Cl.[1] ..... A45F 3/00

[52] U.S. Cl. ..... 224/45 P; 224/45 Q; 224/45 T; 294/15

[58] Field of Search ..... 224/45 R, 45 D, 45 K, 224/45 M, 45 N, 45 P, 45 Q, 45 T; 294/15, 16; 190/41 B, 43

[56] References Cited

U.S. PATENT DOCUMENTS

| | | | |
|---|---|---|---|
| 3,387,752 | 6/1968 | Martin et al. | 224/45 T |
| 3,524,670 | 8/1970 | Ilich | 224/45 R |
| 3,584,772 | 6/1971 | Robertson | 224/45 T |
| 3,705,674 | 12/1972 | Fisher | 224/45 T |
| 4,135,655 | 1/1979 | Brown | 224/45 M |

FOREIGN PATENT DOCUMENTS

| | | | |
|---|---|---|---|
| 382252 | 10/1923 | Fed. Rep. of Germany | 294/15 |

*Primary Examiner*—Stephen Marcus

*Attorney, Agent, or Firm*—Leydig, Voit, Osann, Mayer & Holt, Ltd.

[57] ABSTRACT

A garment bag holder for supporting a garment bag which includes a support member formed of a plate of structural material dimensioned to extend vertically from the palm to the armpit of the user. The support member has an integral hand grip at its lower end rounded to provide a comfortable fit in the closed palm and having a width dimension of approximately palm width. The upper end of the supporting member is formed to provide a comfortable fit in the armpit. A hook receiver at the upper end of the supporting member receives the hook, or hooks, at the top of the garment bag so that the bag with its contents, when suspended on the supporting member, is clamped between the supporting member and the body of the user, the resulting friction against the wall of the garment bag tending to avoid any tendency for the supporting member to topple either forwardly or rearwardly from its position under the arm of the user.

5 Claims, 6 Drawing Figures

10
11
11a
11b
12
13
13a
14
15
16
17
20
21
22
24
25
30
31
32
40
41
D
H

DEVICE FOR CARRYING GARMENT BAG

Garment bags made of flexible material, for example, nylon or other durable fabric, must usually be carried by a traveler because of the reluctance of airlines to include such bags in their checking service. Observation of travelers at any airport or train station reveals that garment bags are carried in one of three ways, folded in half over the arm, suspended from the hook, or hooks, at the upper end or slung over the back.

The first mode of carrying, particularly during warm weather, wrinkles both the sleeve and the enclosed garments. Simply holding the bag from the hook or hooks at the upper end is extremely tiring and often results in the lower end of the bag being dragged along the floor. Slinging the garment bag over one's back is uncomfortable and awkward particularly when one has to carry other baggage as well.

It is, accordingly, an object of the present invention to provide a garment bag holder in which the garment bag is supported vertically with the weight borne at arm's length and which avoids any risk of dragging the bag on the floor.

It is another object to provide a garment bag holder in which all of the garments in the bag remain suspended at full length during transport free of bending or crushing and in which the sleeve of the user is unencumbered and constantly ventilated so as to avoid wrinkles especially in hot, humid weather.

It is another object of the present invention to provide a garment bag holder which enables carrying a garment bag, even when heavily loaded, with other baggage in a natural and dignified way and without the usual fatigue.

It is yet another object of the invention to provide a garment bag holder in which the garment bag is supported from below but which is nevertheless inherently secure and free of any tendency toward toppling either forwardly or backwardly as the bag is carried.

It is an object of the invention in one of its aspects to provide a garment bag holder which includes a simple and novel provision for carrying a briefcase or light valise comfortably and simultaneously in the same hand which supports the bag.

It is also an object of the invention in one of its aspects to provide a garment bag holder which not only permits easy and convenient transport of the bag but which has provision for hanging the bag or its contents from the upper edge of a closet door or the like upon reaching the hotel or other destination.

Other objects and advantages of the invention will become apparent upon reading the attached detailed description and upon reference to the drawing in which:

FIG. 1 is a perspective view showing a garment bag and holder in carrying position.

FIG. 2 is a perspective view showing the holder per se.

FIG. 3 is a fragmentary view showing the simultaneous carrying of a briefcase.

FIG. 4 is a fragmentary cross section taken through the lower portion of the holder with the handle of the briefcase in nested position.

FIG. 5 shows a garment bag holder suspended from the upper edge of a closet door or the like.

FIG. 6 is a fragmentary view showing optional provision for length adjustment.

Figures 1, 2, 3, 4, 5, 6:
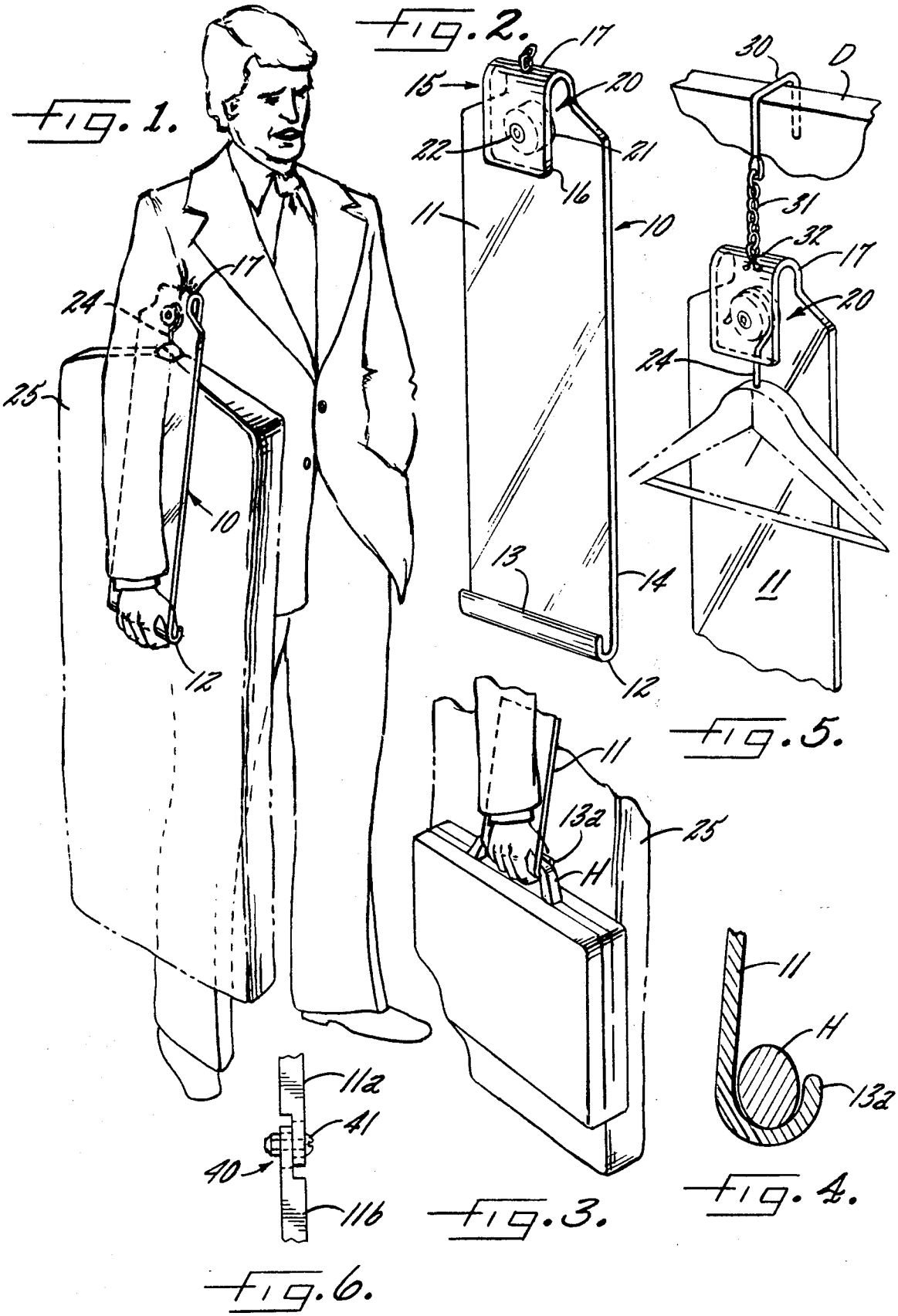

While the invention has been described in connection with a preferred embodiment, it will be understood that I do not intend to limit the invention to the particular embodiment shown but intend, on the contrary, to cover the various alternative and equivalent constructions included within the spirit and scope of the appended claims.

Turning now to the drawing there is disclosed a garment bag holder 10 constructed in accordance with the invention including a body or support member 11 in the form of a flat plate of light weight structural material, for example, thermoplastic plexiglass. The member is dimensioned to extend vertically from the palm to the armpit of the user, as shown, with the arm in substantially straight condition. The support member has an integral hand grip 12 at its lower end in the plane of the member with a width dimension corresponding approximately to palm width. The hand grip is preferably integrally formed by a rounded, upward curl 13 of the base material so as to provide a comfortable fit in the closed palm. For maximum comfort the hand grip is preferably a continuation of the smooth outer surface 14 of the support member, lying in or closely adjacent to the plane of the latter.

At its upper end 15 the member is formed with a downward curl 16 to form a relatively thin rounded upper edge 17 to provide a comfortable fit in the armpit. Bridging the gap between the curl 16 and the body 11 of the member is a hook receiver 20 formed by a spool 21 which is penetrated by a screw or rivet 22. The hook receiver 20 is mounted in a laterally more or less centered position spaced slightly downwardly from the upper edge 17 of the device for receiving the hook, or hooks, 24 of the garment bag indicated, at 25, by the dot-dash outline. Frequently a garment bag will have not only a single hook but will be made up of a plurality of the hooks on a set of hangers which are enclosed side by side in the upper portion of the bag. The disclosed hook receiver 20, with its overlying curl 16 shields the user and his jacket against a cluster of hooks presenting points which may be angled in a number of different directions.

When the garment bag is carried as illustrated in FIG. 1, with the hook receiver turned inwardly, facing the body of the user, the garment bag is effectively clamped between the supporting member and the body of the user, developing sufficient friction so as to inhibit any tendency for the supporting member to topple either forwardly or rearwardly. Thus the only force which need be intentionally applied is the force which is exerted straight up in supporting the weight of the bag and no energy need be expended to keep the bag hanging straight in its transport position. Thus the bag, even when heavily loaded, may be carried for long distances with little effort, that is, no more effort than would be used to carry a small valise of similar weight. Nor need any care be exercised to keep the lower end of the bag free from the floor or ground surface, even where the user is a person of relatively short stature. The holding and carrying of the garment bag, usually an awkward and tiring chore, is made more pleasant amd more comfortable by exercise of the present invention.

While the form of the invention illustrated in FIG. 2 suffices for carrying of the garment bag by itself, it is one of the objects of the invention, in one of its aspects, to provide for the simultaneous carrying of a briefcase or light valise by the same hand which supports the bag. This is accomplished as illustrated in FIGS. 3 and 4 by making the curl, here indicated 13*a*, of sufficiently large radius to accommodate, in the groove formed within it, the handle H of the briefcase or traveling bag. By making the hand grip i.e., the curl, of approximately palm width, the lower end of the handle may be easily inserted into carrying position. This leaves the opposite hand free to carry, in balanced position, a second, or larger, bag.

It is one of the aspects of the present invention to provide, at the upper end of the supporting member, a hook of square configuration intended for slipping over the upper edge of a closet door, the hook being connected to the supporting member in a position vertically alined with the hook receiver by a short length of flexible connector enabling the hook, during transport, to drop downwardly along one side of the supporting member into an out-of-the-way position so as not to affect the fit under the armpit.

Thus I provide a hook 30 of square configuration dimensioned to fit over the top edge of a closet door D or the like, the hook being connected by a short length of chain 31 to a point of connection 32 which is at a position vertically alined with the hook receiver 20. Because of the flexible nature of the length of chain the hook may drop down on either side of the holder, and when in such out-of-the-way position, is not normally felt by the user of the device; certainly it does not interfere with the holding or the carrying of the bag. When the bag is hung on the door the garment bag may be slipped off, as shown in FIG. 5, to make the garments fully accessible.

While it is found that one size of holder is sufficient to accommodate users of average build, plus a margin on either side thereof, the device may be provided in different lengths. Alternatively, provision may be included for adjusting the effective length of the holder; for example, a simple overlapping joint 40 (FIG. 6) may be interposed between upper and lower portions 11*a*, 11*b* of the body of the device held in adjusted position by two or more laterally spaced screws 41 which may be fitted in a selected pair of a series of holes or occupy a selected position in a slot.

It will be apparent that the device amply meets the objects set forth above. In addition, the holder is simple and economical to produce, inherently strong and long-wearing.

What I claim is:

1. A garment bag holder for supporting and transporting in vertical position a garment bag having a hook at its upper end comprising, in combination, a substantially flat structural support member dimensioned to extend vertically from the palm to the armpit of the user with the user's arm in substantially straight condition, the support member having an integral hand grip at its lower end in the plane of the member rounded to provide a comfortable fit in the closed palm and having a width dimension of approximately palm width, the upper end of the supporting member presenting an upper edge formed to provide a comfortable fit in the armpit, a hook receiver member at the upper end of the supporting member laterally centered therein and spaced slightly downwardly from its upper edge for receiving the hook of the garment bag and facing inwardly so that the garment bag when suspended on the supporting member is effectively clamped between the supporting member and the body of the user with the resulting friction against the garment bag tending to inhibit any tendency for the supporting member to topple either forwardly or rearwardly under the arm of the user.

2. The combination as claimed in claim 1 in which the support member is formed of a sheet of thermoplastic material having its lower end curled upwardly to form the hand grip and the upper end curled downwardly to form a curved upper edge for reception under the armpit.

3. The combination as claimed in claim 2 in which the hook receiver is in the form of a bridge extending between the upper curl and the body portion of the support member, the curl being of sufficient width to shield the hook of the garment bag.

4. The combination as claimed in claim 1 in which the hand grip includes an upwardly facing groove of such length and width as to receive the handle of a briefcase or the like for simultaneous carrying adjacent the outer surface of the garment bag.

5. The combination as claimed in claim 1 in which there is provided on the support member a hook of square configuration intended for slipping over the upper edge of a closet door, the hook being connected to the upper end of the supporting member in a position vertically aligned with the hook receiver by a short length of flexible connector enabling the hook, during transport, to drop downwardly along one side of the supporting member into an out-of-the-way position so as not to affect the fit under the armpit.

* * * * *